United States Patent [19]

Bock et al.

[11] 4,362,113

[45] Dec. 7, 1982

[54] MECHANISM GENERATING HELICAL/ELLIPTICAL MOTION

[75] Inventors: Thomas Bock, Schaumburg; Chandrakant Bhatia, Buffalo Grove; George M. Toman, Chicago, all of Ill.

[73] Assignee: Union Special Corporation, Chicago, Ill.

[21] Appl. No.: 904,207

[22] Filed: May 9, 1978

[51] Int. Cl.[3] ..... D05B 1/10; D05B 57/02; D05B 69/02

[52] U.S. Cl. ..... 112/199; 112/220

[58] Field of Search ..... 74/52; 112/55, 199, 112/200, 201, 220, 221

[56] References Cited

U.S. PATENT DOCUMENTS

| | | | |
|---|---|---|---|
| 2,193,344 | 3/1940 | Reece | 74/52 |
| 2,667,135 | 1/1954 | Bell | 112/245 |
| 2,704,042 | 3/1955 | Wallenberg et al. | 112/162 |
| 3,318,274 | 5/1967 | Schoij | 112/248 |
| 3,688,711 | 9/1972 | Szostak et al. | 112/162 |
| 4,022,140 | 5/1977 | Lienemann | 112/199 |

OTHER PUBLICATIONS

*Product Engineering*, 9/28/59, pp. 66, 67.

*Primary Examiner*—Wm. Carter Reynolds
*Attorney, Agent, or Firm*—John W. Harbst; John A. Schaerli

[57] ABSTRACT

A Cardan gear assembly having an output centerpoint means which moves along an elliptical path. A force transfer means connects the output centerpoint to a means operative to carry a work performing means. The major axis swept out by the means operative being skewed with respect to the major axis of the ellipse which is swept out by the output centerpoint. As a result, the work performing means will be swept along a curve which is of a portion of a helix as well as part elliptical. This curve takes the form of a partial helix wherein the outgoing path is different from the return path.

12 Claims, 12 Drawing Figures

MECHANISM GENERATING HELICAL/ELLIPTICAL MOTION

This invention relates to novel drive mechanisms for moving a work performing means along an elliptical/-helical path. More particularly, it is concerned with a sewing machine and the apparatus for driving an upper looper along a reciprocating elliptical/helical path to achieve the manufacture of a Class 500 stitch.

The elements presently required to form a Class 500 stitch include the needle, the lower looper and upper looper. These elements cooperate in a predetermined manner to form the particular 500 class stitch desired. For example, in FIGS. 9–12, there is briefly shown the formation of the well known stitch type 504 wherein the lower looper 502 transports a thread from the left to the right. During its right hand travel thread is picked up from the back side thereof by the upper looper 504 which then moves over a particular path to cooperate with the needle 500. This path, for example, may be helical or in the form of an upside down "J" such that the thread on the back side of the upper looper, as shown in FIG. 11, is presented for engagement with the needle means 500. This presentation takes place in a manner such that thread carried by the upper looper 504 in combination with the sewn fabric 506 forms a triangle through which the needle passes. For a complete discussion of type 504 stitch formation, reference should be made to "Stitch Formation Type 504" published by the Union Special Corporation, 400 N. Franklin Street, Chicago, Ill. 60610.

Unless the size of this triangle can be adjusted over a particular range, adjustment of the machine becomes very critical in that all elements must exactly cooperate. If only a very small triangle is presented by the upper looper to the needle, the needle and looper must be exactly adjusted or the probability of causing missed stitches increases substantially. Various means have been attempted to increase the size of this triangle or window. However, for the most part they have not been totally satisfactory.

In accordance with the invention hereunder consideration, an assembly means is disclosed which drives the tip of the looper out and back through an elliptical/helical path. The tip of the looper thus picks up the thread from the back side of the lower looper, spirals upwardly over a predetermined elliptical/helical path for cooperation with the needle and then spirals back to the initial position over a different elliptical/helical path. The looper tip thus performs what is called by some in the sewing machine industry an "avoid motion". For a full discussion of the "avoid motion" reference should be made to U.S. application Ser. No. 904,204, filed May 9, 1978. The "avoid motion" allows the triangular window presented to the descending needle to be vastly increased. Or at least the operator is given the option of adjusting the triangle over a given range.

Included in the invention as discussed herein is a Cardan gear means that has an output centerpoint means which moves along an elliptical path. A looper bar or lever means is secured in a bearing support means such that only rotational and translational movement is possible. The translational movement of the looper bar sweeps out a straight line path which is skewed from the straight line path which corresponds to the major axis of the ellipse that is being swept out by the output centerpoint. A force transfer means connects the output centerpoint and the looper bar for the transmission of the rotational and translational movement therebetween. The looper means which is affixed to the looper bar will thus have its tip or thread handling portion swept along a path which is a combination of an ellipse and a helix, the total path comprising a full ellipse but only a portion of the complete helix. This causes the thread handling portion of the looper to spiral out along a first path and back to its initial position along a second path.

It is therefore an object of this invention to provide a mechanism for driving a work performing instrumentality through an elliptical/helical like motion. It is yet another object of this invention to provide a balanced drive mechanism for driving the upper looper employed in the creation of a stitch type 504 through a path which includes elliptical and helical motion. But another object of this invention is to provide an upper looper employed in the formation of a Class 500 stitch which has an "avoid motion". Still another object of this invention is to employ a Cardan gear having a force transfer means to drive a work performing instrumentality through an elliptical/helical motion.

Other features and advantages of the invention will appear from the detailed description of the preferred embodiment of the same which will now be given in conjunction with the accompanying drawings in which.

Figure 1:
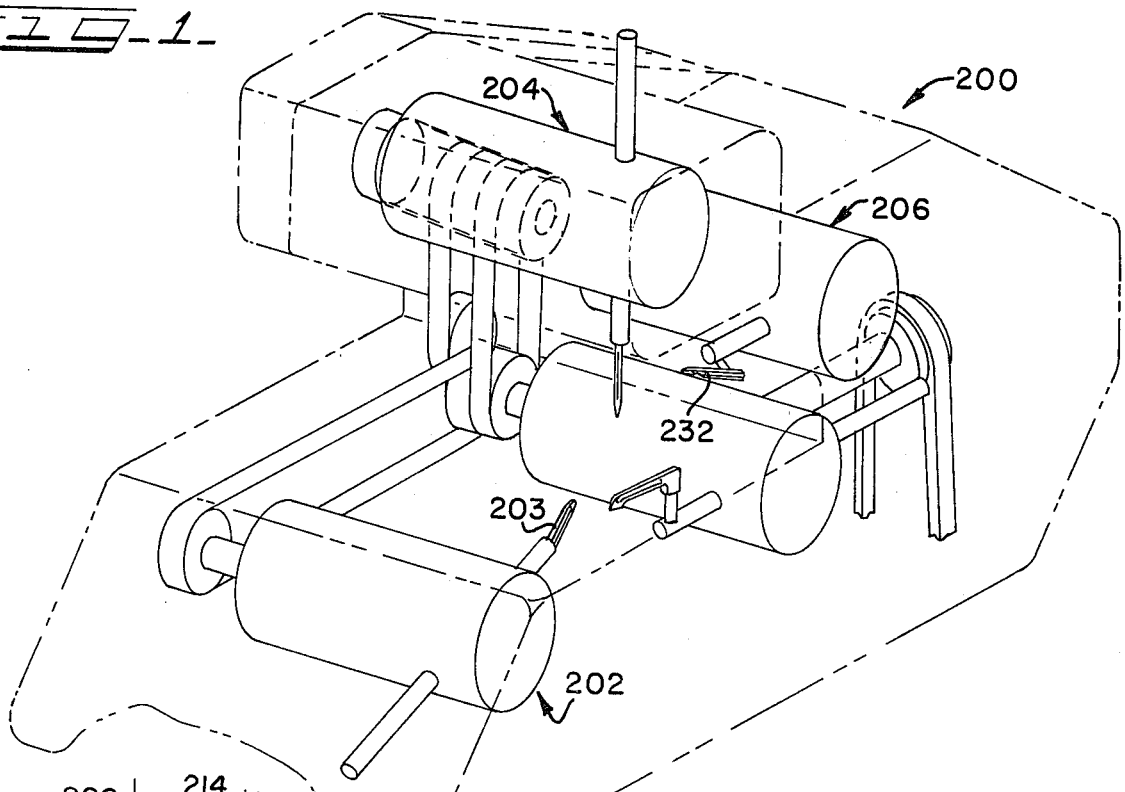
FIG. 1 is a partial isometric view in phantom lines of a sewing machine wherein the upper looper is driven by a Cardan gear type module.

Referring now to the above mentioned drawings, which show the features of the present invention applied to a stylized sewing machine 200. A series of Cardan gear modules are employed to drive the elements which cooperate to form, for example, a 504 stitch. These elements include the lower looper Cardan gear module 202, the needle Cardan gear module 204 and the upper looper Cardan module 206. Each of these Cardan gear modules is generally similar with the exception of the amount of balancing involved. Reference should be made to copending application Ser. No. 908,199 filed May 22, 1978, for a complete discussion of the balancing techniques involved with the needle Cardan Module 204. It should also be understood that the Cardan modules 202 and 204 are substantially the same with the substitution of a needle for a lower looper.

Figure 2:
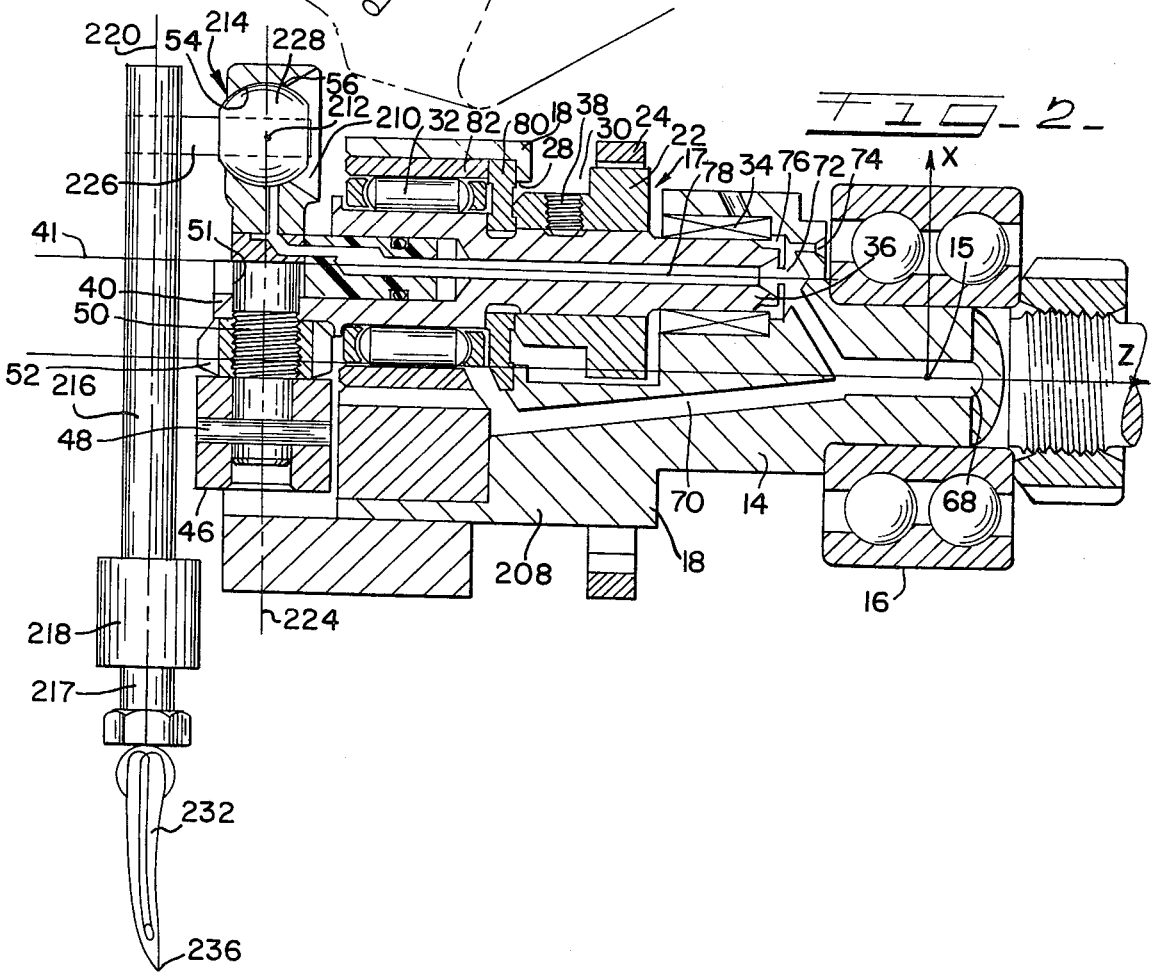
FIG. 2 is a partial view in horizontal section of the Cardan gear module and upper looper assembly.

A portion of the upper looper Cardan gear module 206 is shown in FIG. 2. This includes the Cardan gear drive mechanism 208, output lever means 210 which has an output centerpoint means 212, a force transfer means 214 which connects the output centerpoint means 212 and a lever means or in the preferred embodiment a looper bar means 216.

The drive mechanism 208 includes an enlarged extension or frame means 18 of main or drive shaft 14 supported in cantilever fashion from bearing 16. This frame means 18 is shaped to receive a pinion gear assembly 17 as shown in FIG. 2. The extension 18 is provided with a horizontally extending aperture or cavity 28, as well as a cutaway portion 30. As is apparent, the cutaway portion facilitates the engagement of the pinion gear means 22 with the internal ring gear 24 mounted within the upper looper Cardan gear module 206. The aperture means 28 carries the double speed bearing means which includes first and second bearing sets 32 and 34 which journal the pinion shaft means 36. The set screw 38 is employed to secure the pinion gear 22 to the pinion shaft 36. Secured to the left end 40 of the pinion shaft 36 is a lever or connecting means 210 which connects the work performing instrumentality 216 thereto such that overall a centilevered system is created. The lever means 210 also connects to the pinion shaft 36 a mass 46 which exerts force on said shaft whereby when balanced around line 41 there would be a zero load vector exerted on the double speed bearing means. In the preferred embodiment the mass exerting the force is a counterweight means 46 which is secured to lever means 210 with a pin means 48. The lever means 210 may be provided with a threaded portion 50 designed for engagement with a spanner nut 52. In the preferred embodiment, the lever means is inserted through the aperture means 51 in the shaft means 36 and the spanner nut 52 securely locks the elements in a predetermined position. The lever means 210 adjacent its top portion is provided with an aperture 54. Securely positioned within said aperture is a force transfer means 214.

The work performing assembly 216, in the preferred embodiment, is a looper bar held in position by bearing set means 218. The looper bar means 216 journals bearing means 218 whereby it is capable of rotational and translational motion along and around its longitudinal axis or straight line 220. Connected adjacent end portion 217 of the looper bar means 216 is a thread handling instrumentality or upper looper means 232.

Referring to FIG. 2, it is well known that when the output centerpoint (identified by numeral 212) of the Cardan gear is off the pitch diameter of the ring gear 24, it will trace or sweep out an elliptical path. Thus, no further explanation will be devoted thereto.

The bearing sets hereunder discussion, that is, the main bearing set 16, the double speed bearing sets 32 and 34, and the bearing surface means 56 are all provided with a positive oiling system. Oil enters main channel means 68 under pressure and thereafter passes via auxiliary channeling to each of the respective bearing sets. Bearing set 32 receives oil via channel means 70, bearing set 16 via channel means 72 and 74, bearing set means 34 via 72 and 76 and force transfer means 214 via channel means 72 and 78. Any suitable oil pumping system can be employed as is presently employed in conjunction with industrial sewing machines.

The pinion shaft 36 is secured in place by the provision of a thrust washer 80. A combination of the outer race 82 of the bearing set 32 on one side and the frame means 18 on the other secure thrust washer 80. In the preferred embodiment the thrust washer 80 is a material manufactured by the DuPont Corporation under the trade name "Vespel". The thrust washer 80 provides a substantially friction free abutting surface for the pinion gear 22 whereby the pinion shaft and related assemblies are fixed with regard to the frame assembly.

Figure 4:
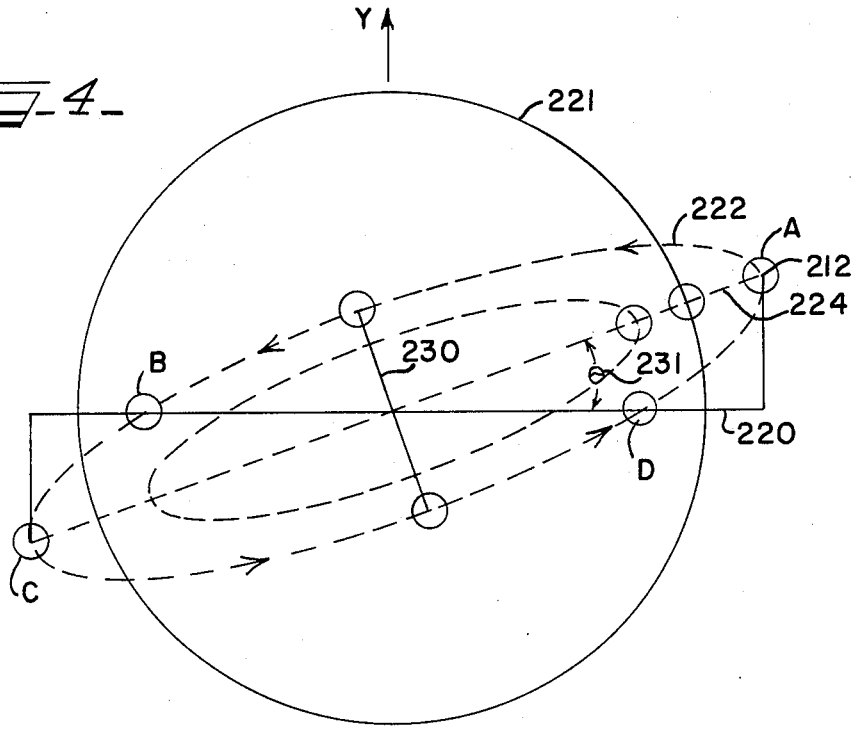
FIG. 4 is a diagrammatic view showing the path of movement of the center of the output pin and the path of movement swept out by the looper bar as it moves along its major axis.
Figure 3:
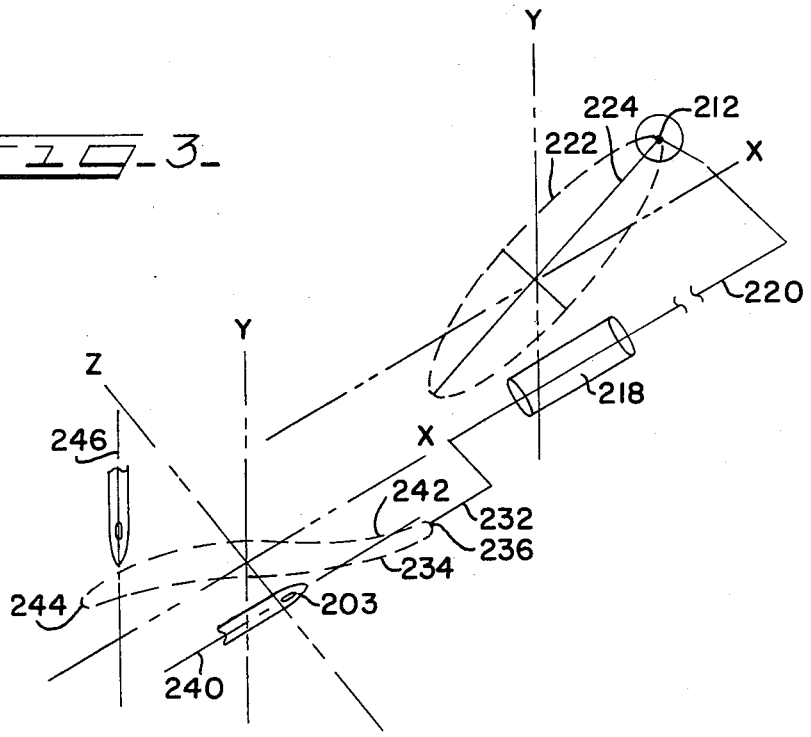
FIG. 3 is a diagrammatic view showing the path of movement of the center of the output pin and the corresponding path swept out by the tip of the upper looper.

Referring now to FIGS. 3 and 4 wherein is shown the general movement of the output centerpoint 212 when it is outside the pitch diameter of the ring gear 24 represented by circle 221. It is well known that upon moving the centerpoint 212 of the output means in or out from the diameter of the ring gear 221 will cause it to travel or traverse along an elliptical path. Take, for the sake of example, the ellipse 222 which has a major straight line axis 224. The straight line major axis 224 as shown in FIG. 3 and 4 is in a plane which is parallel with but spaced apart from the plane wherein is carried major or longitudinal axis 220. For the sake of explanation, let it be assumed that the axis 220 and 224 lie in X, Y planes which parallel that of the paper. This is straight line 224 is in a first plane which is parallel with but spaced apart from a second plane wherein is carried straight line 220. It will be noted from a consideration of FIGS. 3 and 4 that the straight line major axis, 220 is skewed about $28° \pm 3°$ to 5° in the second plane with respect to the straight line major axis 224 of ellipse 222.

Because of the existence of the force transfer means 214 between the looper bar 216 and output center means 212 it is possible to transfer force therebetween. Thus as the output centerpoint 212 moves along ellipse 222 translational or reciprocal force will be transferred to the looper bar 216 causing it to move along line 220. Additionally as the slider pin portion 226 and the ball means 228 slides within the socket 54 rotational or oscillatable force is transferred. Rotational force generally corresponding to about one half the length of line 230 will be imparted to the looper bar means 216. That is the looper bar 216 will be rotated a distance equal to $\frac{1}{2}$ the minor axis of ellipse 222. The translational movement imparted to the looper bar means 216 will be some distance less than the length of line 224.

A point therefore on the surface of the looper bar 216 will simultaneously be moved rotationally and reciprocably. A looper means or other work performing instrumentality 232 will thus be moved through a generally elliptical/helical path such as line 234. This path 234 is swept out in this particular example by the tip 236 of the looper 232. It should be noted that the path 234 includes a full ellipse in combination with a a part of a helix. That is the tip 236 is swept through about a complete ellipse like curve but only about the first one third or so of a complete helix. The lead and diameter of the particular helix will be determined by the angle theta 231. The angle theta represents the number of degrees whereby line 224, being the major axis of the ellipse swept out by centerpoint 212, is skewed with respect to line 220 which is swept out by looper bar 216. The elliptical portion of path 234 is contributed by moving the output centerpoint 212 off the pitch diameter of the ring gear. That is, some distance either in or out of the pitch diameter, the distance determining the size of the major and minor axis.

Again making reference to FIGS. 9 through 12 wherein is shown the formation of a standard 504 stitch. In FIG. 3 the path of the lower looper 203 is generally represented by the line 240 cooperating with the tip 236 of the looper 232 at the beginning of the work cycle generally in the area of 242. It should be noted that the looper tip 236 passes in back of the lower looper means 203. The tip 236 of the upper looper 232 then continues to the left until it reaches the end of the stroke at point 244. Thereafter in a manner akin to an avoid motion, the tip 236 moves back along the curve 234 to create a greater window or triangle for penetration by the tip of the needle which moves generally along line 246 behind the body of looper 232. As is apparent from considering FIGS. 9 through 12 in the event the tip 236 of the looper 232 moves out and back over the same path certain limitations are placed on the maximum size of the window which is opened up. However as herein described when the looper tip 236 moves out over a first path corresponding to the first leg of a helical/ellipse and then moves back over a second path corresponding to the second leg of the helical/ellipse it is possible to substantially increase the size of the triangle. This allows a system to be designed which provides greater tolerance to adjustment. That is the various element which drives the needle, lower looper and upper looper, can be manufactured and designed to more modest tolerances and still form an overall combination which successfully creates an acceptable stitch. Additionally, the larger triangle creates a degree of forgiveness in the system that would allow some needle deflection or whatever and still form the desired stitch.

Figure 5:
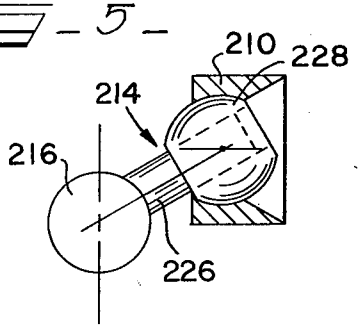
FIGS. 5, 6 and 7 are partial views showing the relationship of the force transfer means to the output means and the looper bar at different points during the work cycle.
Figure 6:
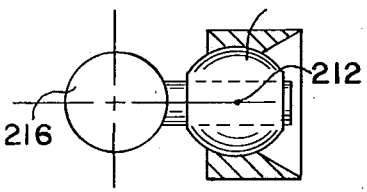
Figure 7:
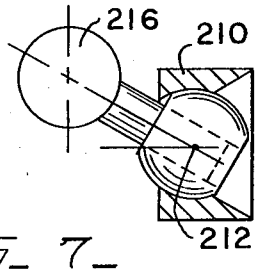

Referring now to FIGS. 5, 6 and 7 which show the relationship between the looper bar means 216 and the output lever 210 which carries the force transfer means 214. The position shown in FIG. 5 corresponds to position "A" in FIG. 4. FIG. 6 corresponds to position "D" while FIG. 7 corresponds to "C". It is apparent the pin means 226 slides back and forth within ball means 228 during a complete work cycle.

The term balancing, as employed with respect to the development herein disclosed, is indicative of the situation where load vectors and moment on the main bearing set are eliminated. In order to achieve this result the load vectors and generally the moment to which the pinion shaft is subjected are balanced with respect to the axis thereof. That is the pinion gear assembly is balanced with respect to load vectors and the moment is minimized, around a line which passes through the center of the pinion shaft. As is appreciated when the pinion gear assembly functions within the Cardan gear module means constant load vectors are produced thereby as well as additional moment due to centrifical effect on the cantilever system. These constant load vectors and moment are then balanced with respect to the axis of the main shaft. The resultant being the elimination of force vectors and moment on the main bearings.

The term load vectors as used herein refers to the direction and magnitude of forces generated in the various systems. Both this term and the term moment, which is the force acting on a pivot point through a radius are employed in the manner as well in the art.

Balancing of the Cardan gear module means has been pursued with the intent of either minimizing or at best eliminating the effects of inertia forces on the operating quality of the system. It has been found that the degree to which the unresolved inertia forces can be minimized or eliminated will depend upon the particular path through which the work performing means is being driven. If the inertia forces in the system were not resolved their presence could result in fluctuating and reversing loads which in turn could produce increased stress in members, and impacts between loosely fitted elements. The result being higher noise levels and wear and reduced fatigue life of the loaded elements.

Balancing of the system may be approached from two different directions. The first approach is on a theoretical level which attempts to predict the state of the unresolved inertia forces and develop their solutions prior to actual manufacture of the component parts. A second method utilizes actual parts and analyzes their unresolved inertia forces due to manufacturing tolerances, for example, by using a balancing machine. This second method as is apparent is well known in the art and therefore no further discussion will be made thereto.

By employing the theoretical approach a theoretical model of a Cardan gear means can be developed. In this particular model through an understanding of the unresolved inertia forces it is possible to make intelligent selection of bearings and the selection and assignment of materials to obtain reasonable stress levels. Additionally, it is possible to proportion the mass of the various elements in order to resolve the inertia forces. The first step in developing the theoretical model is to establish the mode of operation and the function of the Cardan gear system. Specifically, the Cardan gear means operates in a dynamic mode and is capable of driving an output element or work performing means along several different paths of motion. For example, various paths being straight line, helical, ellipse like or a combination of helical and elliptical.

Thus prior to actual design the motion of the work performing means is fixed or decided upon. The geometric relationship of the Cardan gear elements is thus established. To facilitate the development of the mathematical model several assumptions are made about the physical properties of the system under consideration. First, all elements of the mechanism are considered rigid bodies. The effects of deflection are assumed negligible as to their effects on inertial balancing. Secondly, the natural frequency of all the elements is considered to be above the normal operating frequency of the Cardan gear mechanism. Thirdly, the mass of the various mechanical components are lumped. Thus the dynamic analysis of only a few discrete points need be conducted. The lumping, of course, consists of concentrating all of the elements massed at the center of gravity thereof. Lastly the main crank or drive shaft input angular velocity is held constant.

Figure 8:
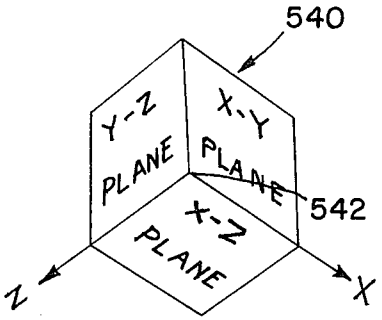
FIG. 8 is a model representation showing various factors acting upon the system during a work cycle.
Figure 8:
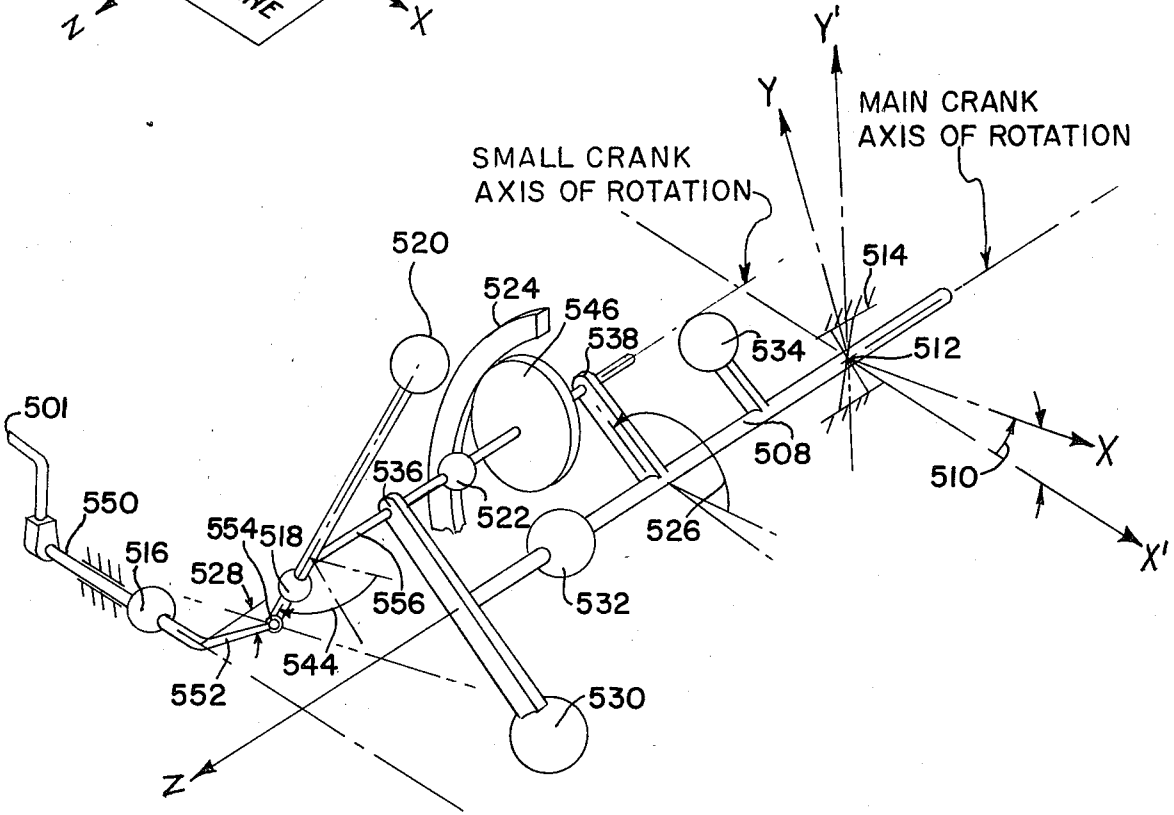
Figure 9:
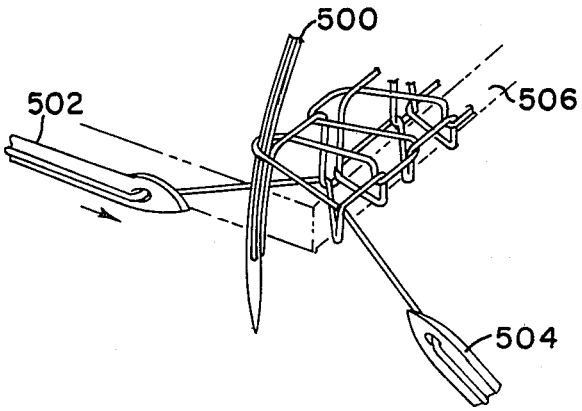
FIG. 9 PRIOR ART
FIGS. 9–12 are partial views showing one mode of 504 stitch formation as known in the prior art.
Figure 10:
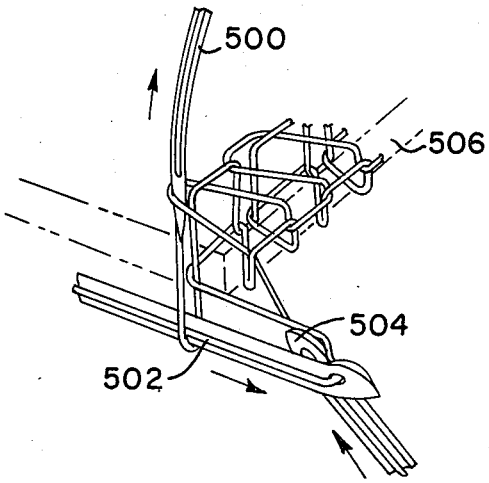
FIG. 10 PRIOR ART
Figure 11:
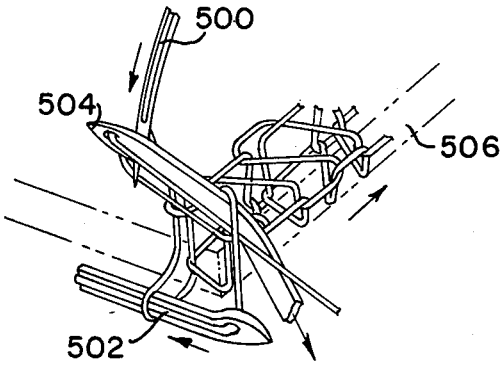
FIG. 11 PRIOR ART
Figure 12:
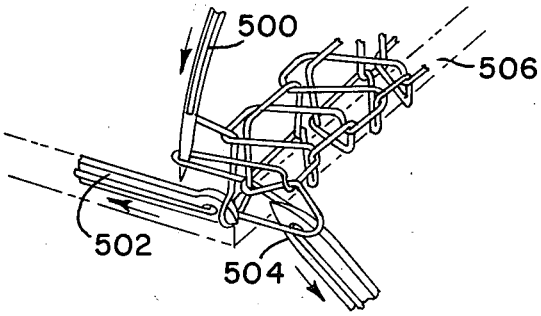
FIG. 12 PRIOR ART

The components or elements which comprise the Cardan gear means are broken down into their basic groups. The dynamic inertia forces of the most basic group is then analyzed. These forces are then superimposed on the second basic group and that group is balanced. The resulting forces are then superimposed upon the third basic group which is ultimately balanced. As shown in FIG. 8 the first basic group includes the looper bar means 550 and everything carried thereby as well as the slider pin portion 552 of the force transfer means 554 which is secured to the looper bar means. The second basic group includes the small crank or pinion shaft 556 and everything carried thereby. The third basic group encompasses the main crank or main drive shaft 508 and all elements carried thereby. In each of these basic groups the masses are lumped in such a manner as to retain the same inertial properties as the actual group. All of this results in a simplified theoretical model of a Cardan mechanism in which a few lumped masses with a specific positional relationship to each other represent the actual mechanism.

Referring to FIG. 8 two spatial right hand coordinates systems have been established for specifying the relationships of the basic components to each other.

The global coordinate system defined in terms of X' and Y', has the looper means or output bar 550 orientated with respect to it. The main drive shaft 508 and the pinion shaft 556, however, are orientated with respect to a local coordinate system. The local coordinate system (defined in terms of X, Y and Z) lies directly on the global coordinate system and can rotate about one common axis which in practice is Z. This common Z axis as will be noted is also the axis of rotation of the main drive shaft 508. As is appreciated in order to drive the tip of the work performing means 501 through certain motions such as, for example, helical or helical/elliptical, it is required that the local system be rotated (skewed) with respect to the global system. The angle 510 represents the amount of skew. This entails using a coordinate transformation to go from one system to another. Both coordinate systems are fixed and do not move in any with with respect to any of the Cardan gear elements as they travel through a work cycle. Both the global and local coordinate systems have their origin at the center 512 of the main bearing means 514. The planes of interest wherein various basic components operate, are defined by two axes of a given coordinate system.

With the theoretical model decided upon, the mathematical equations defining the kinematic properties thereof may be developed. Since the inertial forces of the looper bar means 550 and other components in the first basic group cannot be easily balanced within themselves the load is transferred to the pinion shaft 556, the point of lumped mass thereof being represented at 516. The pinion shaft as shown in FIG. 8 is represented by three lumped masses 518, 520 and 522 and three points of force interaction. These points of force interaction corresponding to the two double speed bearing means 536 and 538 and the force transfer means 554. The looper means 500 inertia load is transferred through one point of force interraction, i.e., the force transfer means 554 and the two double speed bearing means simulate the support for the pinion shaft or small crank 556. The ring gear 524 is not considered a point of force interaction in the kinematic analysis and only serves as a geometric constrain for pinion shaft 556. Because the pinion shaft 556 is restrained in a cantilevered fashion and also because of space limitations, it is not easy to balance off the unresolved inertia forces in two planes. Therefore, the mathematical analysis of the small crank is conducted in a single plane (static balancing). This is a parallel X, Y plane located through the pinion shaft counterweight lumped mass 520. The lumped mass of the pinion shaft double speed bearing journal and pinion shaft itself are neglected for the present because they lie on the line of rotation. Three kinematic position relationships can be developed for the pinion shaft's 556, counterweight and strap lumped mass points 518 and 520 and the point of work performing means force interaction 554. These three relationships uniquely define the independent variables (crank angle 526) relationship with the dependent variables (the position of points with respect to main shaft or crank). One further kinematic position relationship is required. The looper means rotational relationship with respect to the independent variable is needed to fully define this subsystem. The angle 528 defines the amount of this rotation. The angle 544 defines the angular relationship between the pinion shaft 556 and the local coordinate system. This relationship is fixed by the constraint of the pinion gear 546 and ring gear 524 engagement.

The first derivative of these four relationships will produce the velocity of the points of concern. The second derivative will produce the velocity of the points of concern. The second derivative will produce the accelerations of these points. The utilization of Newton's second law of kinetics will determine both the magnitude and the direction of the unresolved inertia forces acting in this particular X, Y plane of the pinion shaft 556. As is appreciated all of the masses and geometric relationships being developed are set up in general form allowing changes to be made to any variable with the purpose of optimizing the system. When the summation of the inertial forces remains constant and the summation of moment about the pinion shafts axis of a rotation equal zero for 360° of rotation of the main shaft, the pinion shaft 556 may be considered statically balanced in the X, Y plane. That is the pinion shaft 556 is considered balanced around it major axis. It will be noted that when the moment about the pinion shaft 556 equals zero, the constant resultant vector force radially rotates around the main shaft at the main shafts angular velocity. This fact allows balancing of this inertia force on the main shaft 508 by adjusting the main crank counter balance means 530, 180° out of phase thereby obtaining an equilibrium of forces and moments with respect to the main bearing set.

The main shaft 508 inertia force analysis is done in two planes (static and dynamic balancing). The main shaft and related elements are represented by three lumped masses 530, 532 and 534, and three points of force interaction; the main bearing 514, and the two double speed bearing means 536 and 538. The first step in resolving the inertia forces of the main shaft is to transfer all of the pinion shaft 556 resultant forces to the double speed bearing points of force interaction 536 and 538. These forces will act on the main shaft 508 in equal magnitudes but in opposite directions. When all the forces and moments (transferred and inertial) acting on the main shaft 508 at the center 512 of the main bearing 514 in two planes is equal to zero, the main shaft can be considered balanced both statically and dynamically. Since the transferred and inertia forces acting on the main shaft 508 remain constant through an operating cycle the main shaft needs to be balanced at only one position. The main shaft counterweight mass 530 may be adjusted independently in the two balancing planes. These two planes are the X-Y and the Y-Z planes, which both pass through the center of the main bearing. For clarification, reference should be made to the orthographic plane representation 540 shown in FIG. 8. It should be noted that the point 542 projects into the plane of the page.

Several important aspects have arisen as a result of this analysis. First it will be noted that the mass of a counterweight, for example 520, can be reduced and positioned further from the axis of rotation and still retain its inertial equilibrium. This fact can be used on the pinion shaft 556 to reduce the constant resulting inertial forces to a lower magnitude whereby reducing the load at the double speed bearing. The result is a longer double speed bearing life and lower stress in the related parts. Secondly, from this analysis it is apparent that it is not necessary to balance the pinion shaft in two planes, rather, only static balancing is required. The resulting state of balance at the main shaft 508 is the same, regardless of whether or not the pinion shaft 556 is dynamically balanced.

The above analysis can be applied to at least four different work performing means and their related output path. Each of these various paths or motions presents their own particular relationships and problems. But, it must be noted that straight line motion can be considered separate from the elliptical, helical, and helical/elliptical motion. For example, with straight line motion or output of the work performing means, the balancing analysis is straightforward. Theoretically, the Cardan gear means which drives a work performing means along a straight line path can be totally balanced with the proper selection of the pinion shaft and main shaft counterweights. However, allowing for manufacturing tolerances, etc., it is appreciated that theoretical can never be absolutely achieved but rather only approached. The balancing of the elliptical, helical and helical/elliptical output motions proceeds in the same manner as that for straight line motion. However, as previously explained not only must the work performing means be reciprocated along the major axis of the looper 550 but it also must be rotated therearound (the angle 528 shown in FIG. 8). This gives rise to a rotational inertia torque which acts about the main axis of the looper means. Balancing in the conventional way will not resolve this torque. As the angle of rotation of the work performing means increases so does the magnitude of the inertia torque.

It has been found that by adjusting the pinion shaft counterweight mass 520 the inertial imbalance can be reduced or eliminated. For example, if the work performing means is being driven through an elliptical output motion it is possible to approach a totally balanced system. With both the helical and helical/elliptical output motions, a larger work performing means rotational angle is required. In this case adjustment to the pinion shaft counterweight mass is used to reduce the magnitude of force fluctuations and moment reversals on the small pinion to a minimum. Total balance of these two output motions cannot be brought to approach theoretical but can be brought to an acceptable level whereby the total Cardan gear mechanism can perform in an acceptable manner. In these two modes of output motion, gear reversal on the pinion shaft can be eliminated, allowing control of pinion gear impacts. As is appreciated, when the pinion shaft counter weight is treated in this manner, the pinion shaft will appear to be unbalanced when an attempt is made to balance it about its major axis. However, when assembled within the total Cardan gear means the entire assemblage when balanced around the main bearing such as 514 will be optimumly balanced.

Thus it is apparent that there has been provided, in accordance with the invention, a helical/elliptical motion that fully satisfied the objects, aims, and advantages set forth above. While the invention has been described in conjunction with specific embodiments thereof, it is evident that many alternatives, modification, and variations will be apparent to those skilled in the art in light of the foregoing description. Accordingly, it is intended to embrace all such alternatives, modifications, and variations as fall within the spirit and broad scope of the appended claims.

What is claimed:

1. A sewing machine having a series of elements adapted to form a stitch, one of said elements comprising:

work performing means;

Cardan gear means having an output which has a centerpoint means arranged relative to the Cardan gear means such that it generally sweeps out an ellipse having a major axis; and lever means having said work performing means arranged for movement therewith, said lever means being operatively connected to said Cardan gear means output and mounted for reciprocal and oscillatable movement along and about its longitudinal axis, said longitudinal axis being skewed with respect to the major axis of said ellipse such that said work performing means is moved in an elliptical/helical like path.

2. The sewing machine of claim 1 wherein:

said machine includes a needle means adapted for endwise movement;

said lever means is a looper bar means and is carried by bearing means; and said work performing means is a looper means.

3. The sewing machine of claim 2 wherein said Cardan gear means includes a ring gear and said centerpoint means is located outside the pitch diameter of the ring gear.

4. The sewing machine of claim 3 wherein said looper means has a tip means which is driven along a path from below the needle means upwardly such that it sweeps behind and around the path taken by the needle then returns via a path which takes it in front of said needle path.

5. An apparatus for converting rotary input motion into elliptical/helical like output motion comprising:

Cardan gear means having an output centerpoint means which moves along an elliptical path;

lever means restricted by a bearing means whereby only rotary and translational movement about and along a straight line path is possible, said straight line path being skewed with respect to the major axis of an ellipse defined by the elliptical path of said output centerpoint means;

work performing means carried by said lever means; and connections between said output centerpoint means and said lever means for moving said work performing in an elliptical/helical path.

6. The sewing machine of claim 3 wherein the longitudinal axis of said lever means is skewed about 28°±5° relative to the major axis of the ellipse traced by the centerpoint means.

7. A sewing machine adapted to form a Class 500 stitch, said sewing machine having an upper looper and an apparatus for driving the upper looper along an elliptical/helical like path comprising:

an output centerpoint means driven by a Cardan gear means such that it tranverses an elliptical path;

a looper bar means journaling a bearing means whereby rotary and translational movement along a given straight line path is possible, said straight line path being skewed with respect to the major axis of an ellipse defined by the elliptical path of said output centerpoint means;

a force transfer means connecting said looper bar means and said output centerpoint means whereby rotational and translational motion is transferred therebetween; and said upper looper means being connected to said looper bar means and driven simultaneously through a full elliptical like and through a partial helical like curve.

8. The apparatus of claim 7 wherein said Cardan gear means includes a ring gear and said output centerpoint means is outside the pitch diameter of said ring gear.

9. The apparatus of claim 7 wherein the straight line path swept out by said looper bar means is skewed about 28°±3° with respect to the major axis of said ellipse.

10. The apparatus of claim 7 wherein:

the elliptical path traversed by the output centerpoint means moves in a first X, Y plane:

said straight line path of said looper bar means being in a second X, Y plane parallel with but spaced away from said first X, Y plane; and said curve swept out by said looper means is in the X-Y and Y-Z planes.

11. The apparatus of claim 7 wherein said Cardan gear means includes a ring gear and said output centerpoint means is within the pitch diameter of said ring gear.

12. A sewing machine designed for the creation of a stitch which includes at least one means for driving a needle along a straight line path which cooperates with a looper means to form the desired stitch wherein the improvement comprises:

a balanced Cardan gear means having an output pinion shaft means which carries an output lever means that includes an output centerpoint, said output centerpoint sweeping out an ellipse which has straight line major and minor axis;

an elongated bar means for carrying said looper means and capable of motion along and around its major axis, the major axis of said elongated bar means being skewed with respect to the major axis of said ellipse; and a force transfer means connecting said output centerpoint and said elongated bar means whereby upon operation of said Cardan gear means said looper means is driven along a path which is part helical like and part elliptical like.

* * * * *